United States Patent [19]

Yamada et al.

[11] 4,295,112

[45] Oct. 13, 1981

[54] RESIDUAL CURRENT TRANSFORMER

[75] Inventors: Yoshito Yamada; Hiroshi Okumura; Shoji Murakami, all of Sagamihara, Japan

[73] Assignee: Mitsubishi Denki Kabushiki Kaisha, Tokyo, Japan

[21] Appl. No.: 71,360

[22] Filed: Aug. 30, 1979

[30] Foreign Application Priority Data

Aug. 30, 1978 [JP] Japan ..... 53-105930
Dec. 15, 1978 [JP] Japan ..... 53-155454

[51] Int. Cl.[3] ..... H01F 15/04; H01F 40/06

[52] U.S. Cl. ..... 336/84 M; 336/174; 336/178; 336/234

[58] Field of Search ..... 336/172, 165, 178, 234, 336/233, 229, 84 R, 84 M, 174, 175, 173, 155

[56] References Cited

U.S. PATENT DOCUMENTS

| | | | |
|---|---|---|---|
| 1,318,787 | 10/1919 | Mollerhoi | 336/178 |
| 1,700,689 | 1/1929 | Sparks | 336/172 |
| 1,722,167 | 7/1929 | Wilson | 336/172 X |
| 2,284,406 | 5/1942 | D'Entremont | 336/172 X |
| 3,146,393 | 8/1964 | Gibbon | 336/229 X |
| 3,430,175 | 2/1969 | Matsuoka et al. | 336/229 X |
| 4,160,966 | 7/1979 | Kennedy | 336/233 |

FOREIGN PATENT DOCUMENTS

| | | | |
|---|---|---|---|
| 673231 | 1/1930 | France | 336/234 |
| 40-47902 | 10/1965 | Japan . | |
| 53-29527 | 3/1978 | Japan . | |
| 823386 | 11/1959 | United Kingdom | 336/172 |

OTHER PUBLICATIONS

Rajchman et al. "The Transfluxor, " *Proceedings of the I.R.E* vol. 44, Mar. 1956, pp. 321-332.

*Primary Examiner*—Thomas J. Kozma
*Attorney, Agent, or Firm*—Oblon, Fisher, Spivak, McClelland & Maier

[57] ABSTRACT

A residual current transformer comprises an annular magnetic core which has not a gap nor sectional part crossing said magnetic core but has one or more narrow sectional area parts.

8 Claims, 27 Drawing Figures

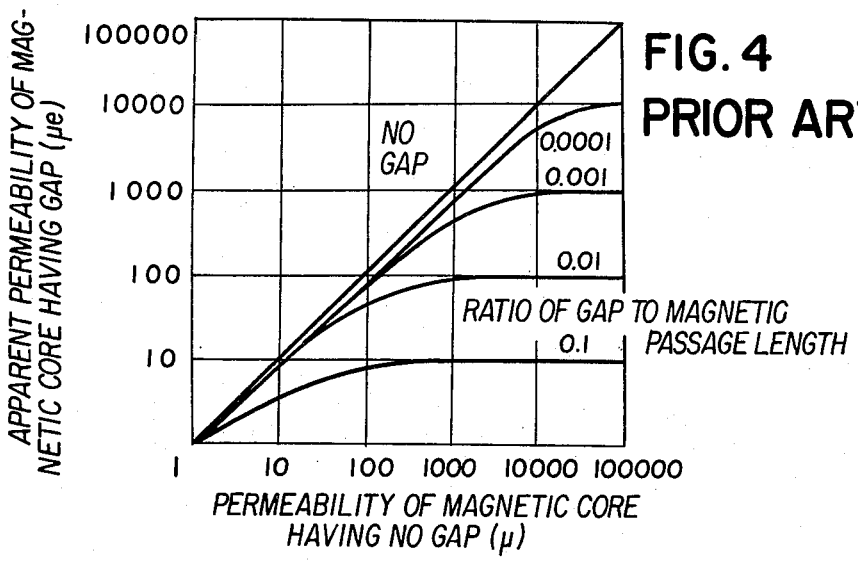
FIG. 4
PRIOR ART
FIG. 5
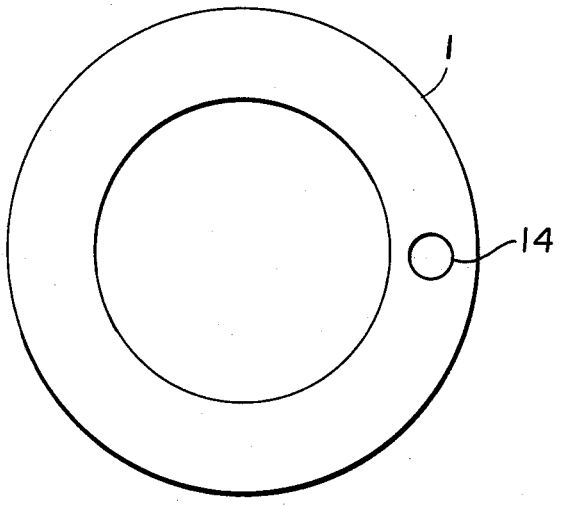
FIG. 6
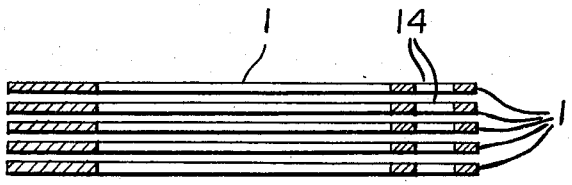

FIG. 11
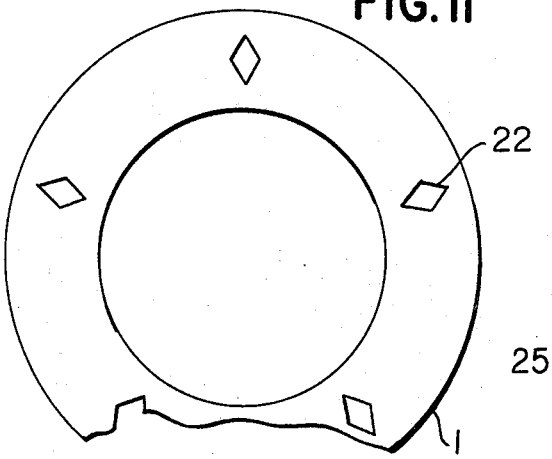
FIG. 14
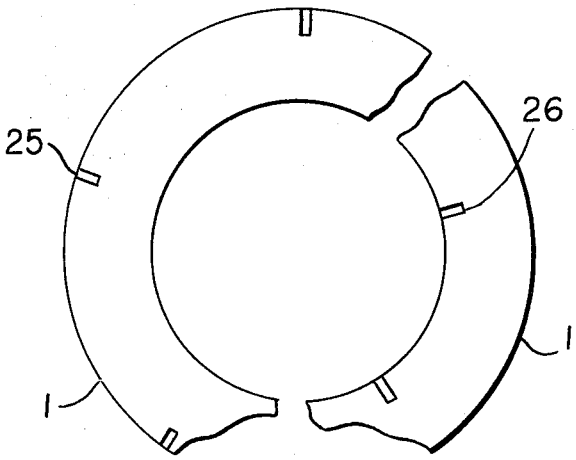
FIG. 15
FIG. 12
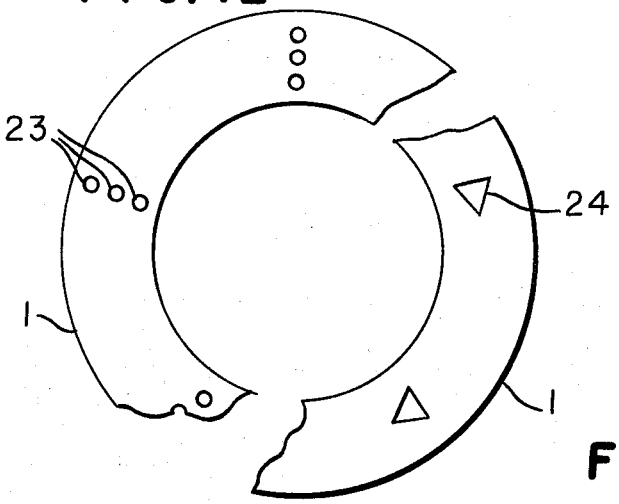
FIG. 13
FIG. 16 FIG. 17
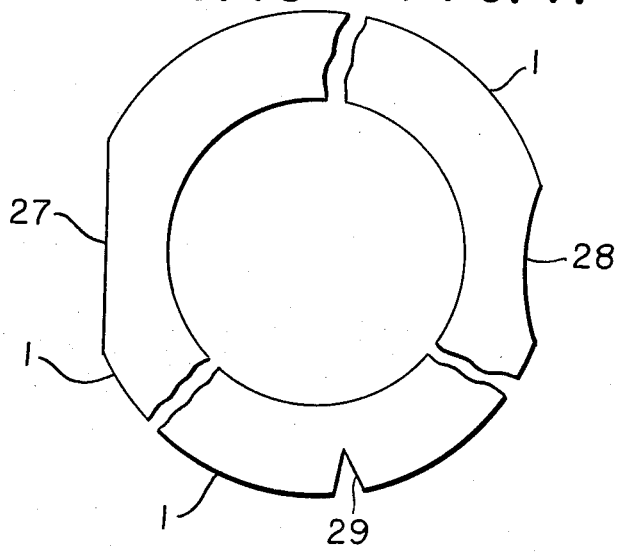
FIG. 18

FIG. 19
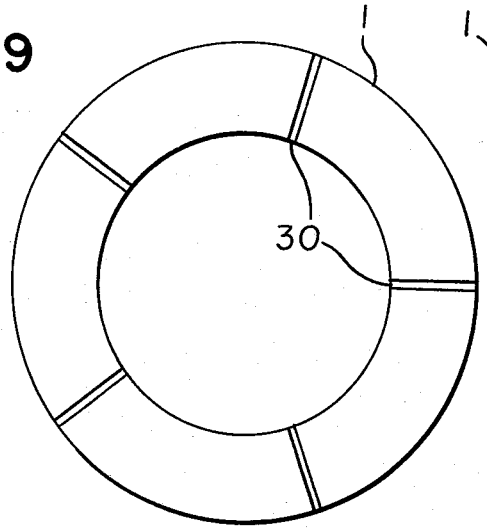
FIG. 20
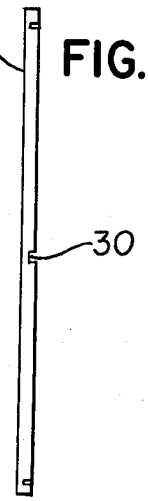
FIG. 21
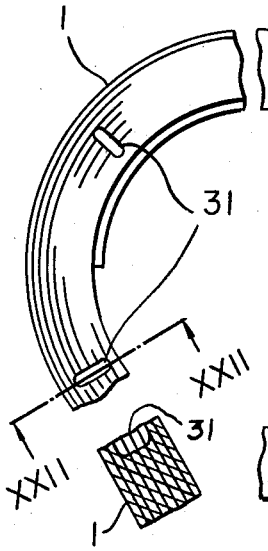
FIG. 22
FIG. 23
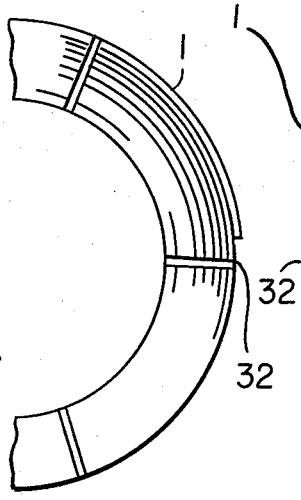
FIG. 24
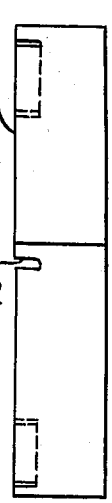

RESIDUAL CURRENT TRANSFORMER

BACKGROUND OF THE INVENTION

1. Field of the Invention

The present invention relates to a residual current transformer for detecting earth leakage current etc. The present invention is to improve an overinput characteristic as one of the important main characteristics of a current transformer by using an annular or frame like magnetic core of the current transformer which has no gap nor sectional part crossing the magnetic passage but has at least one narrow sectional part in the magnetic passage.

The present invention is also to provide a residual current transformer having excellent characteristics of the improved over-input characteristics and small residual output of unbalanced characteristics by using a magnetic core having said narrow sectional area part and an annular shield made of a magnetic substance on a secondary winding wound on the magnetic core.

2. Description of the Prior Arts

Referring to FIGS. 1 and 2, the conventional residual current transformer will be illustrated.

In FIGS. 1 and 2, the reference numeral (1) designates a laminated magnetic core; (2) designates a box for holding a magnetic core; (4) designates the secondary winding of the current transformer; (5) designates an insulating tape or a box for holding the current transformer; (6) designates a filler made of a varnish or a synthetic resin; (7) designates an opening for passing the primary conductor; (8) designates a terminal wire of the secondary winding; and (10) designates the primary conductor; and (11) designates an insulating coat.

Such conventional current transformer comprises a slit remained in parallel to the opening surface in the inside of the annular magnetic core i.e. the opening side and the other part covered by the doughnut form magnetic shield covering the magnetic core. The other conventional current transformer comprises a flat annular magnetic plate at the side surface of the current transformer in parallel to the opening of the magnetic core. The other conventional current transformer comprises a magnetic shielding plate along the inner peripheral part or the outer peripheral part of the current transformer.

When alternating current having the same reverse currents are passed through the primary conductor (10) of the residual current transformer, the magnetizations of the magnetic core (1) surrounding the primary conductor are respectively cancelled to be substantially zero. When a current leak of a load is given, the cancellation of the magnetizations is not completed so as to cause a magnetization by the current corresponding to the unbalanced current i.e. the leak current, whereby an electromotive force corresponding to the leak current of the secondary winding is formed.

When the leak current having more than allowable limit is passed in the load side, the electromotive force of the secondary winding corresponding to the leak current (output) or its signal actuates the breaking mechanism to break the current in the primary conductor circuit in leak thereby preventing a damage.

The residual current transformer is a device for detecting such small current. The primary conductor can be a three phase AC circuit. The operation mechanism is the same as the former one. Thus, the residual current transformer should actuates a breaking mechanism in high reproducible, by the leak current having greater than the predetermined current, whereby it is necessary to have desirable AC secondary output, overinput characteristic and unbalanced characteristic (residual output characteristic).

In order to provide the desired AC secondary output, it is necessary to have higher permeability and smaller loss.

The overinput characteristics means the phenomenon that the output of the residual current transformer is relatively decreased to increase the working current after passing large leak current such as the earthing short-circuit of the residual current transformer. The overinput characteristic is given by dividing a deteriorated output after passing the large leak current by the output before passing the large leak current and shown as a percent. The specification limit of the characteristic is usually less than 10–15% and preferably smaller.

It is considered that the deterioration of sensitivity is usually depending upon the magnetization characteristic of the magnetic core (1).

FIG. 3 shows the magnetization characteristic of the magnetic core wherein the excitation magnetic field is plotted on the abscissa and the magnetization is plotted on the ordinate. The full lines of (10)-(8)-(11) show the magnetization curves. The loop (12) shows the magnetization curve corresponding to the magnetization by the normal alternating current whereas the line (9) shows the magnetization curve corresponding to the magnetization by the alternating current near the residual magnetization after passing the large excitation current. The reference numeral (8) designates the point of the magnetization of the magnetic core at the time passing the large excitation current; and (10) and (11) respectively designate coercive forces. When the residual magnetization (Br) after passing the large excitation current is higher, the position of the magnetization curve (9) is higher so as to decrease its gradient. The gradient is lower than the gradient of the magnetization curve (12) near the normal initial permeability thereby decreasing the secondary output induced in the secondary winding. Thus, the working current is deteriorated to deteriorate the overinput characteristic. As described above, the overinput characteristic is deteriorated after passing the large excitation current because the magnetization is remained at the point Br shown in FIG. 3. Thus, it is considered to be enough to use a magnetic core having lower Br. As one method, a magnetic core having a gap such as a separate type magnetic core is used, the magnetization curve shown by the chain line in FIG. 3 is given to decrease the residual magnetization to the point (13) of B'r whereas the permeability is remarkably decreased. FIG. 4 is a well-known graph showing the condition of the decrease of the permeability. When a gap having a ratio of 1/10,000 to the magnetic length of the magnetic core is formed, that is a gap of $10\mu$ is formed in the magnetic core of a diameter of 3 cm (magnetic length of about 10 cm), the apparent permeability is decreased to 1/10 (10,000) for the magnetic core having apermeability of 100,000. It is difficult to obtain large output in such case.

When the non-leak balanced current is passed through the primary conductor of the residual current transformer, the secondary output may not be generated, however a slight noise output is generated in the practical operation.

The residual output percent is given by dividing the noise output by the working output. In such case, the balanced current is three times of the rated current (less than 20 A of rated current in single phase); or two times of the rated current (greater than 20 A of rated current in single phase); or several times depending upon the condition of the lines and the standard in a manufacturing company.

The noise output is depending upon the relative relation between the residual current transformer and the primary conductor. The magnetic core is rotated around the primary conductor. The maximum output is given as the unbalanced characteristic that is, the residual output.

In accordance with the normal process, these various characteristics are mutually affected in the same magnetic core to have the complicated relations and the design of the magnetic core is severely limited disadvantageously and the complicated process for preparing the magnetic core is required disadvantageously.

SUMMARY OF THE INVENTION

It is an object of the present invention to provide a residual current transformer having excellent overinput characteristics.

Another object of the present invention is to provide an excellent residual current transformer which has a satisfactory over-input characteristic and a small residual output.

The residual current transformer of the present invention is to provide a desired overinput characteristic by forming one or more narrow sectional parts in a magnetic core having no gap nor sectional part crossing the magnetic passage; and to improve the residual output characteristic by covering the secondary winding of the magnetic core with an annular shield made of a magnetic substance.

BRIEF DESCRIPTION OF THE DRAWINGS

FIG. 4 is a graph showing the relation between the size of the gap in the magnetic core and the decrease of the apparent permeability;

FIGS. 5 and 6 respectively plane and sectional views of one embodiment of the magnetic core used in the present invention;

FIGS. 8 to 25 show the other embodiments of the magnetic cores used in the present invention;

FIGS. 8 to 18 are respectively plane views of the magnetic core;

FIG. 19 is a plane view of the magnetic core plate;

FIG. 20 is a side view of the magnetic core plate of FIG. 19;

FIG. 21 is a plane view of one embodiment of a wound type magnetic core;

FIG. 22 is a sectional view taken along the XXII—XXII line of FIG. 21;

FIG. 23 is a plane view of the other embodiment of a wound type magnetic core;

FIG. 24 is a sectional view of the magnetic core of FIG. 23;

FIG. 25 is a schematic view of the other embodiment of a wound type magnetic core used in the present invention;

DETAILED DESCRIPTION OF THE PREFERRED EMBODIMENTS

Figure 1:
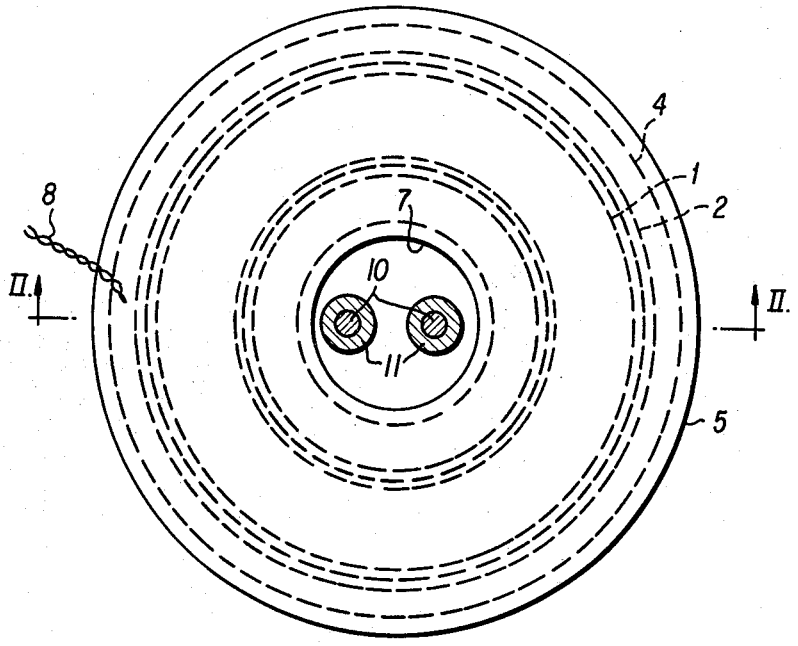
FIG. 1 is a plane view of the conventional residual current transformer using a laminated type magnetic core.

FIGS. 5 and 6 are respectively a plane view and a sectional view of one embodiment of the present invention.

The reference numeral (1) designates annular magnetic core plates and (14) designates holes formed in the magnetic core plates and a laminated magnetic core is formed by plying the magnetic core plates to arrange the holes at the same position. The narrow sectional area part is formed in the annular magnetic passage of the magnetic core by the holes (14).

Figure 7:
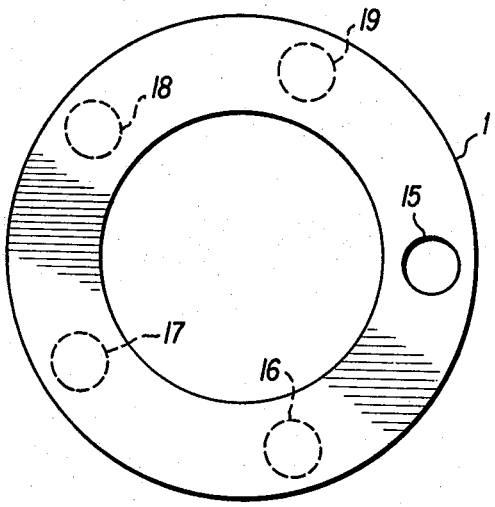
FIG. 7 is a plane view of the other embodiment of the magnetic core used in the present invention.

In the other embodiment, the magnetic core plates (1) are plied so as to arrange the holes at positions distributed with substantially equal gaps as shown in the plane view of FIG. 7 wherein the reference numeral (1) designates a magnetic core plates; and (15), (16), (17), (18) and (19) respectively designate holes in each of the magnetic core plates.

A secondary winding (1000 T) is wound on the magnetic core shown in FIG. 5 or FIG. 7 to give the secondary load of 5 kΩ and the AC primary current of 20 mA is passed through the primary conductor. The results of the output and the overinput characteristic are shown in Table 1.

TABLE 1

| | Sample No. | Output (mV) A | Output after passing large excitation current (mV) B | Overinput characteristics $\frac{A-B}{A} \times 100$ (%) |
|---|---|---|---|---|
| Laminated | 1-34 | 35.0 | 33.0 | 5.7 |
| magnetic core | 1-35 | 34.3 | 32.3 | 5.8 |
| arrange of holes at same position | 1-36 | 35.2 | 33.4 | 5.1 |
| Laminated | 1-37 | 35.5 | 33.4 | 5.9 |
| magnetic core | 1-38 | 35.5 | 33.5 | 5.6 |
| arrange of holes in equal gap | 1-39 | 35.6 | 33.8 | 5.1 |
| Conventional | 1-31 | 35.6 | 30.6 | 14.0 |
| laminated | 1-32 | 35.2 | 30.5 | 13.4 |
| magnetic core | 1-33 | 36.1 | 30.9 | 14.4 |

Primary current: 20 mA

The samples 1-34, 1-35 and 1-36 are the currenttransformers having the magnetic cores arranging holes at the same position shown in FIG. 5. The average output is 34.8 mV and the average output after passing a large excitation current of DC 50 A is about 32.9 mV. Accordingly, the overinput characteristic is about 5.5%.

The samples 1-31, 1-32 and 1-33 are the current transformers having the conventional magnetic cores having no hole. In accordance with the measurements under the same condition, the average output is about 35.6 mV and the average output after passing a large excitation current is about 30.7 mV. Accordingly, the overinput characteristic is about 13.9%. The results show that the current transformer using the laminated magnetic core arranging holes at the same position shown in FIG. 5 has significant lower overinput characteristics than that of the conventional one even though the conditions of the size and the secondary winding are completely the same. Moreover, the results also show that the output is not substantially decreased to be quite different from the magnetic core having a gap or the divided type magnetic core.

The samples 1-37, 1-38 and 1-39 are the current transformers having the magnetic cores having each hole arranging the holes with substantially equal gap by turning the magnetic core plates having each hole as shown in FIG. 7.

In accordance with the measurements under the same condition, the average output is about 35.5 mV and the average output after passing a large excitation current is about 33.6 mV. Accordingly, the overinput characteristic is about 5.5%. The results shows that the current transformer shown in FIG. 7 is significantly superior to the conventional current transformer and the output is not decreased at all.

Figure 9:
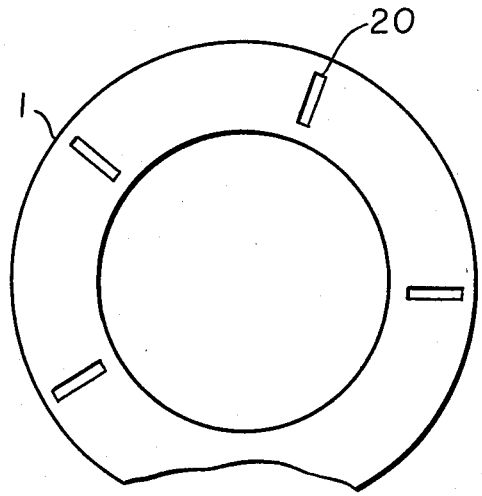
Figure 8:
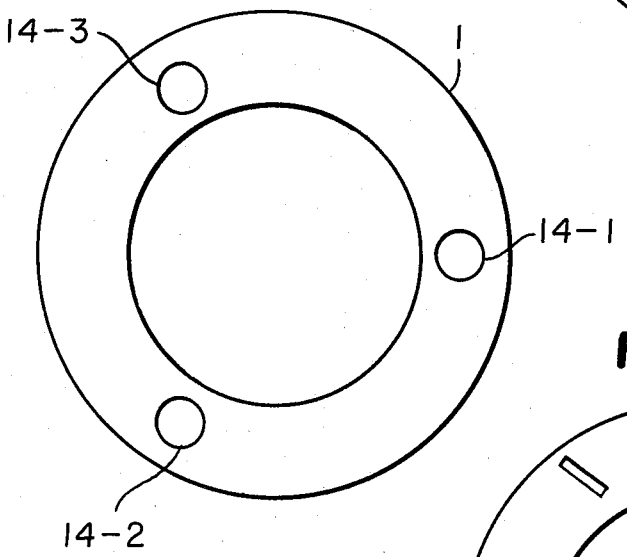
Figure 10:
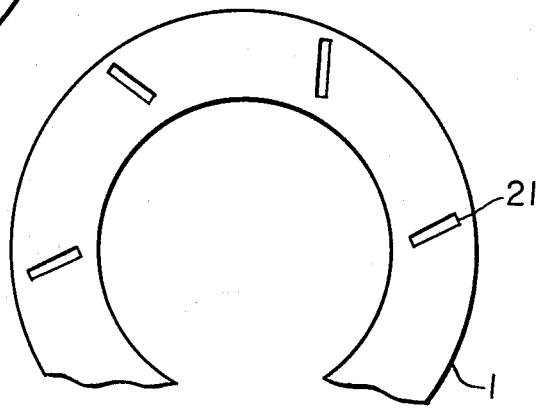

In the magnetic core, only one narrow sectional area part is formed by each circular hole in each magnetic core plate. Thus, the hole is not limited to one but many holes such as three holes (14-1), (14-2), (14-3) can be formed in each magnetic core plate as shown in FIG. 8. The size and the shape of the hole are not limited to a circular hole but can be selected as desired. Rectangular holes (20) are formed in FIG. 9; and rectangular holes (21) arranged to have certain angle to the center line are formed in FIG. 10; rhombus holes (22) are formed in FIG. 11; small holes (23) are formed in FIG. 12; triangular holes (24) are formed in FIG. 13. These holes are formed one or more positions in the plate magnetic core, the filled magnetic core and the wound magnetic core.

In the embodiments of FIGS. 8 to 13, the narrow sectional area part is formed by forming the holes.

In the embodiments of FIGS. 14 and 15, the narrow sectional area part is formed by notches (25) or (26) in the magnetic core. One or more notches can be formed at any position of the outer or inner peripheral part of the magnetic core.

The samples of the magnetic cores are prepared from ingots which are quite different from the substrates of the samples shown in Table 1. The test results are shown in Table 2.

TABLE 2

| | Sample No. | Output (mV) A | Output after passing large excitation current (mV) B | Overinput characteristics $\frac{A-B}{A} \times 100$ (%) |
|---|---|---|---|---|
| Laminated magnetic core having notches on outer peripheral | 2-35 | 33.9 | 32.0 | 5.6 |
| | 2-36 | 34.1 | 32.2 | 5.6 |
| Laminated magnetic core having chord cut | 2-37 | 33.4 | 31.2 | 6.6 |
| | 2-38 | 33.2 | 30.8 | 7.2 |
| Conventional laminated magnetic core | 2-38 | 34.5 | 28.3 | 18.0 |
| | 2-29 | 34.5 | 28.5 | 17.4 |

Primary current: 20 mA

The samples 2-35 and 2-36 are the current transformers having the magnetic cores having each notch arranging notches with substantially equal gap by turning the magnetic core plates having each notch (25) as shown in FIG. 14.

In accordance with the measurements under the same condition for the data in Table 1, the average output is about 34.0 mV and the average output after passing a large excitation current is about 32.1 mV. Accordingly, the overinput characteristic is about 5.6%. These values especially the overinput characteristics are significantly superior to the value of the samples 2-28 and 2-29 of the conventional current transformers having no notch of about 34.5 mV, about 28.4 mV and about 17.7%.

In the embodiments of FIGS. 16 to 18, the narrow sectional area part is formed by the chord cut (27); the arc cut (28) and the V notch (29).

The samples 2-37 and 2-38 are the current transformers having the magnetic cores having each chord cut arranging the narrow sectional area parts with substantially equal gap.

In accordance with the measurements under the same condition, the average output is about 33.3 mV; the average output after passing a large excitation current is about 31.0 mV and accordingly, the overinput characteristic is about 6.9% which is significantly superior to those of the samples 2-28 and 2-29 of the conventional current transformer.

Even though the cut part is large and the magnetization is small in these embodiments, but the decrease of the output as the magnetic core having the gap is not found.

FIGS. 19 and 20 are respectively plane view and the side view of the embodiment of the magnetic core plate having a groove (30) on the front or rear surface thereof.

The magnetic core plates for the laminated magnetic core are shown in these embodiments. Thus, the function is the same in the case of the filled magnetic core.

It is easy to form the narrow sectional area part in the wound magnetic core.

FIGS. 21 and 22 are respectively the plane view and the sectional view of the embodiment of the wound magnetic core having the notch (31) at a part except the corners of the sectional end surface.

FIGS. 23 and 24 are respectively the plane view and the side view of the embodiment having the notches (32) on the side surface of the tapes of the wound magnetic core.

Figure 25:
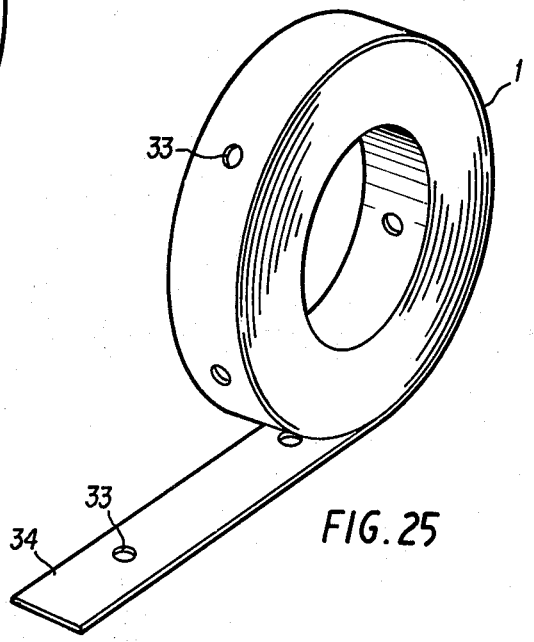

FIG. 25 is a schematic view of the embodiment of the wound magnetic core made of the tape (34) having holes (33).

Figure 2:
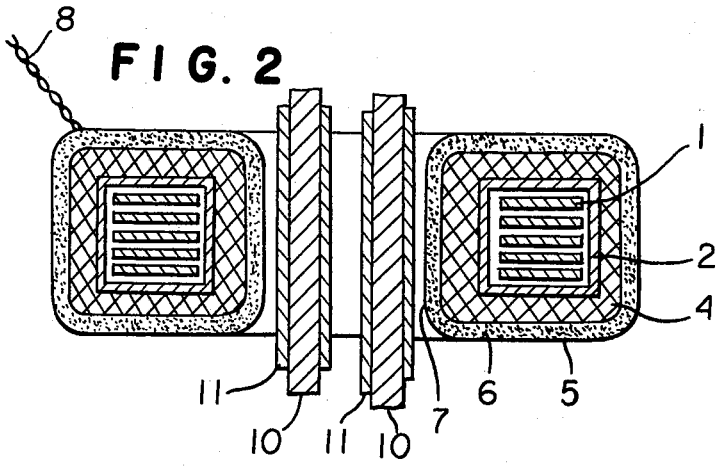
FIG. 2 is a sectional view taken along the line II—II of FIG. 1.
Figure 3:
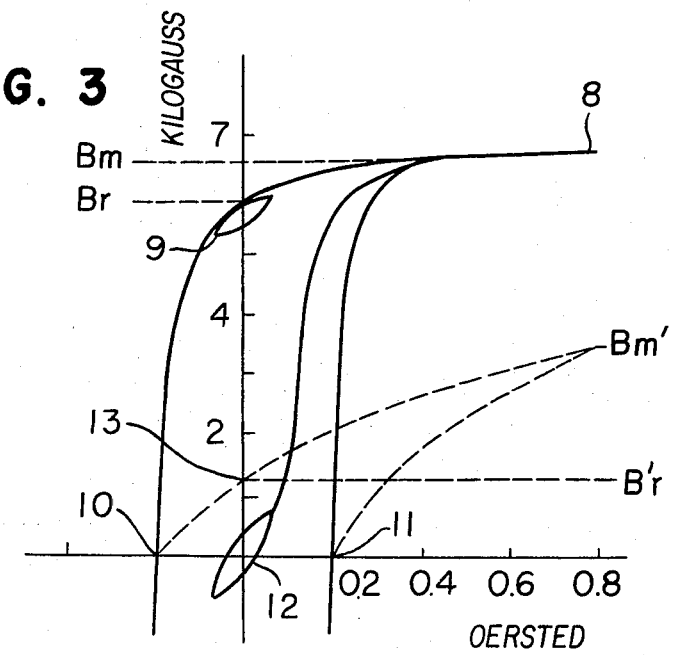
FIG. 3 is a graph showing variations of the magnetization curve for illustrating the overinput characteristics and the magnetization curve in the case of forming the gap in the magnetic core.

In these embodiments, the magnetic core of the residual current transformer shown in FIGS. 1 and 2 is substituted by the magnetic core having the narrow sectional area part of the magnetic passage.

In the other embodiment of the current transformer of the present invention, the magnetic core (1) having the narrow sectional area part of the magnetic passage is used and the annular shield plates (3) made of the magnetic substance are placed on the upper and lower surfaces of the secondary winding (4) in parallel to the window plane of the core.

Table 3-1 shows the shapes of the samples of the laminated magnetic cores having the narrow sectional area part of the present invention which are respectively prepared by forming each hole in each magnetic core plate and plying them; and the conventional magnetic cores.

Table 3-2 shows the results of the measurements of the secondary output, the overinput characteristics, the percent residual outputs and the residual percents of residual output of these samples.

TABLE 3-1

| Sample No. | Type of residual current transformer | Shape: Narrow part | Shape: Laminated condition | Figure |
|---|---|---|---|---|
| 3-1 | Mag. core having narrow part | One hole 1 mm $\phi$ | 5 mag. core plates are arranged to be same hole position | FIG. 5 |
| 3-2 | Mag. core having narrow part | One hole 1 mm $\Phi$ | 5 mag. core plates are arranged to be same hole position | " |
| 3-3 | Mag. core having narrow part | One hole 0.8 mm $\phi$ | 5 mag. core plates are arranged to be same hole position | " |
| 3-4 | Mag. core having narrow part | One hole 0.8 mm $\phi$ | 5 mag. core plates are arranged to be same hole position | " |
| 3-5 | Mag. core having narrow part | One hole 1 mm $\phi$ | 5 mag. core plates are arranged to shift 72° gap | FIG. 7 |
| 3-6 | Mag. core having narrow part | One hole 1 mm $\phi$ | 5 mag. core plates are arranged to shift 72° gap | " |
| 3-7 | Conventional mag. core | None | 5 mag. core plates are arranged | FIG. 1 |
| 3-8 | Conventional mag. core | None | 5 mag. core plates are arranged | " |

TABLE 3-2

| Sample No. | AC second output (mV) | Percent residual output (%): No shield (A) | Percent residual output (%): Shield (B) | Residual percent of residual output $\frac{B}{A}$ (%) | Residual output in shield (mV) | Overinput characteristic (%) |
|---|---|---|---|---|---|---|
| 3-1 | 29.4 | 77.2 | 8.2 | 11 | 2.4 | 2.9 |
| 3-2 | 30.3 | 73.6 | 4.0 | 5 | 1.2 | 2.5 |
| 3-3 | 30.4 | 33.4 | 1.6 | 5 | 0.5 | 0.0 |
| 3-4 | 30.5 | 35.8 | 2.3 | 6 | 0.7 | 1.0 |
| 3-5 | 30.4 | 68.8 | 6.3 | 9 | 1.9 | 2.2 |
| 3-6 | 30.3 | 52.8 | 3.6 | 7 | 1.1 | 2.2 |
| 3-7 | 30.3 | 9.6 | 4.0 | 42 | 1.2 | 10.1 |
| 3-8 | 30.5 | 16.1 | 8.2 | 51 | 2.5 | 10.3 |

The magnetic core plate has a width of 2.0 mm and an average diameter of 15 mm.

In Table 3, the AC secondary output is the output obtained by passing the alternating current of 50 Hz and 22 mA through the one turn primary conductor, and the residual output is the value obtained by passing the balanced alternating current of 100 A through a pair of the primary conductors having the rated current of 30 A.

The preparations of these magnetic cores in Table 3 are the same except the formation of the holes and the structures and sizes of the current transformers and the conditions for the measurements are the same.

The samples 3-1 and 3-2 are the current transformers having the five magnetic core plates having each hole (diameter: 1 mm) arranging the holes at the same position.

The samples 3-3 and 3-4 are the current transformers having the five magnetic core plates having each hole (diameter: 0.8 mm) arranging the holes at the same position.

The samples 3-5 and 3-6 are the current transformers having the five magnetic core plates having each hole (diameter: 1 mm) arranging the holes with equal gap of 72°.

The samples 3-7 and 3-8 are the current transformers having the five magnetic core plates having no hole as the conventional one.

The shapes of the magnetic core are referred to the corresponding figures.

The material preparations of these narrow sectioned cores and conventional magnetic cores are the same whereby the temperature characteristics of the output are the same.

The residual current transformers having the magnetic cores having the narrow sectional area parts 3-1 to 3-6 (with or without the shield plate) have substantially equal secondary output to that of the conventional residual current transformer 3-7 and 3-8.

The overinput characteristics are about 2 to 3% in the samples 3-1 and 3-2; about 2% in the samples 3-5 and 3-6; about 0 to 1% in the samples 3-3 and 3-1 which are significantly superior to the overinput characteristics of about 10% in the sample of 3-7 and 3-8 for the conventional ones.

The percent residual outputs are different depending upon the diameter and arrangement of the holes in the magnetic cores in the case of the residual current transformers having no shield plate shown in FIG. 1. When the magnetic core having the narrow sectional area part is used, the percent residual outputs are in a range of 80 to 30% whereas when the conventional magnetic core (no narrow sectional area part) is used, the percent residual outputs are 9.6% and 16.1%.

In the conventional residual current transformer having the same magnetic core, the secondary output, and the overinput characteristics are not different regardless of the shield plate, however the percent residual output is remarkably decreased to be improved as ½ as shown in Table 3 when the shield plate is used.

The residual percent of residual output shows the percent of the percent residual output in the case having the shield plate to the percent residual output in the case having no shield plate in the residual current transformer.

The residual percent of residual output of the residual current transformer having the magnetic core having the narrow sectional area part is in the range of about 5 to 11% which is remarkably superior to 30 to 50% of the residual percent of residual output of the conventional residual current transformer. In the residual current transformer of the present invention having no shield plate, the percent residual output is remarkably high as 80 to 30% whereas remarkable attenuation effect is caused by the shield plate to give the low percent residual output residual percent of 5 to 11%. As a result, the percent residual output is lowered to 8.2 to 1.6% as the average of 4.3% by the shield plate. The percent residual output of the conventional current transformer with the shield plate is in the range of 8.2 to 4.0% as the average of 6.1% which is equal or inferior to those of the present invention.

When the residual outputs themselves are compared, the residual percents of the residual outputs of the residual current transformers of the present invention are in a range of 2.4 to 0.5 mV as the average of 1.3 mV which are equal or superior to the residual outputs of the conventional residual current transformer having magnetic shield plate of 2.5 mV and 1.2 mV as the average of 1.9 mV. The residual outputs of the samples 3-1 and 3-2 (the positions of the holes are arranged at the same position) are substantially the same with those of the samples 3-5 and 3-6 (the positions of the holes are shifted with equal gap) which have the plied five magnetic core plates in the same condition.

The condition may be the severest when the holes are arranged at the same position. However, the characteristics of the residual current transformers of the invention are substantially the same, regardless of the positions of the holes as the data of the samples 3-1, 3-2 (same position) and the samples 3-3 and 3-1 (shifted positions).

When a plurality of the narrow sectional area parts are formed in the magnetic core by the holes or notches, the characteristics of the residual current transformers are measured.

The results are shown in Tables 4-1 and 4-2. The conditions for the measurements are the same as those of Table 3. (The ingot numbers of the samples are different).

TABLE 4-1

| Sample No. | Type of residual current transformer | Shape: Narrow part | Shape: Laminated condition |
|---|---|---|---|
| 4-9 | Mag. core having narrow part | two holes 1 mm $\phi$ | 5 mag. core plates are arranged to be same hole position |
| 4-10 | Mag. core having narrow part | two holes 1 mm $\phi$ | 5 mag. core plates are arranged to be same hole position |
| 4-11 | Mag. core having narrow part | three holes 1 mm $\phi$ | 5 mag. core plates are arranged to be same hole position |
| 4-12 | Mag. core having narrow part | six holes 0.8 mm $\phi$ | 5 mag. core plates are arranged to be same hole position |
| 4-13 | Mag. core having narrow part | six holes 1 mm $\phi$ | 5 mag. core plates are arranged to be same hole position |
| 4-14 | Mag. core having narrow part | twelve notches | 5 mag. core plates are arranged to be same hole position |
| 4-15 | Mag. core having narrow part | twenty-four notches | 5 mag. core plates are arranged to be same hole position |
| 4-16 | Conventional mag. core | None | 5 mag. core plates are plied |

TABLE 4-2

| Sample No. | AC second output (mV) | Percent residual output (%): No shield (A) | Percent residual output (%): Shield (B) | Residual percent of residual output $\frac{B}{A}$ (%) | Residual output in shield (mV) | Overinput characteristic (%) |
|---|---|---|---|---|---|---|
| 4-9 | 28.0 | 33.2 | 3.9 | 12 | 1.1 | 3.9 |
| 4-10 | 27.4 | 27.4 | 4.0 | 15 | 1.1 | 2.7 |
| 4-11 | 25.7 | 103.1 | 6.6 | 6 | 1.7 | 5.1 |
| 4-12 | 27.5 | 23.3 | 4.0 | 17 | 1.1 | 9.6 |
| 4-13 | 26.6 | 51.9 | 7.9 | 15 | 2.1 | 10.7 |
| 4-14 | 27.2 | 11.0 | 5.1 | 46 | 1.4 | 14.2 |
| 4-15 | 26.5 | 22.6 | 7.2 | 32 | 1.9 | 14.8 |
| 4-16 | 26.6 | 35.2 | 9.8 | 28 | 2.6 | 15.4 |

The samples 4-9 and 4-10 respectively have two holes (diameter: 1 mm); the samples 4-11 has three holes (diameter: 1 mm); the sample 4-12 has six holes (diameter: 0.8 mm) with the equal gap; the sample 4-13 has six holes (diameter: 1 mm) with the equal gap; the sample 4-14 has twelve notches on the outer peripheral part of the magnetic core (1) shown in FIG. 14 and the sample 4-15 has twenty four notches as shown in FIG. 14.

The secondary outputs are slightly different. Those of the samples 4-9 to 4-15 of the residual current transformers having the narrow sectional area part are substantially equal to that of the conventional residual current transformer 4-16 having the uniform magnetic core.

The overinput characteristics of the residual current transformers are about 3% in the case of two holes; about 5% in the case of three holes; about 10% in the case of six holes. The superior characteristic is given when the number of the holes is smaller or the diameter is 0.8 mm than that of 1.0 mm or the number of the notches is smaller.

When the number of the narrow sectional area parts is larger, the overinput characteristic is disadvantageously larger so as to approach the datum of the magnetic core having no narrow sectional area part.

The percent residual outputs of the residual current transformers having the narrow sectional area parts and no shield plate shown in FIG. 1, are in the range of 11 to 103% whereas that of the conventional one is 35%.

Figure 26:
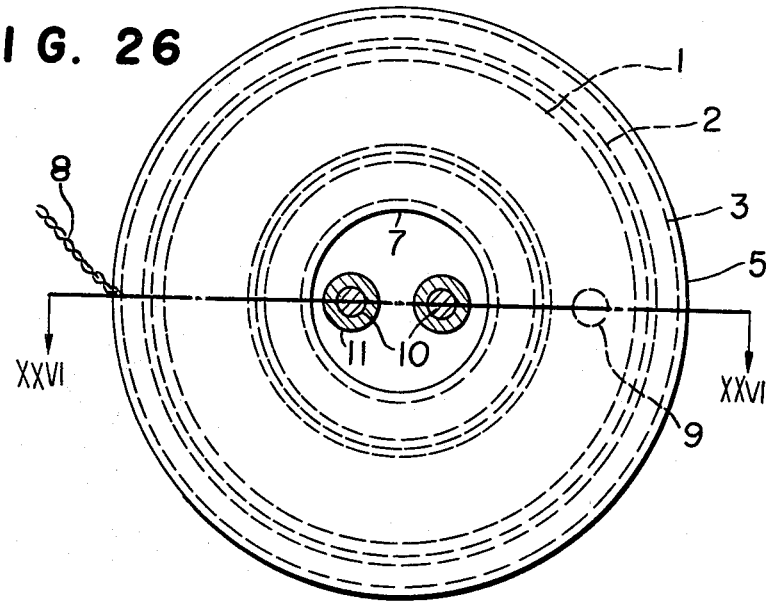
FIG. 26 is a plane view of the other embodiment of the residual current transformer of the present invention.
Figure 27:
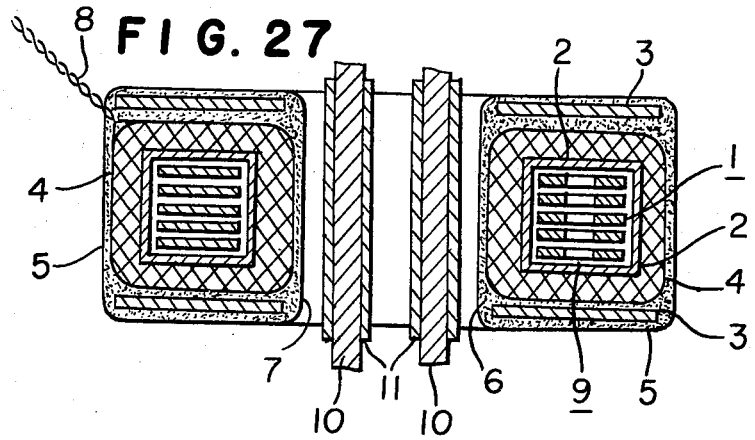
FIG. 27 is a sectional view taken along the XXVI—XXVI line of FIG. 26.

The percent residual outputs of the residual current transformers having the narrow sectional area parts and also the shield part shown in FIGS. 26 and 27, are in the range of 3.9 to 7.9% as the average of 5.5% which are advantageously lower than 9.8% of that of the conventional one having the shield plate.

The residual outputs themselves of the residual current transformers of the present invention shown in Table 4 are in the range of 1.1 to 2.1 mV as the average of 1.6 mV which are equal or superior to that of the conventional one of 2.6 mV.

Among the samples shown in Tables 3 and 4, the best characteristics in all viewpoints, are given by the residual current transformer having the magnetic core which is formed by plying five magnetic core plates having each one hole (diameter: 0.8 mm) (the samples 3-3 and 3-4), and the shield plate which have the AC secondary outputs of 30.4 mV and 30.5 mV; the overinput characteristics of 0.0% and 1.0%; the percent residual outputs as the unbalanced characteristics of 1.6% and 2.3% and the residual outputs of 0.5 mV and 0.7 mV.

These are remarkably superior to the conventional residual current transformers having the conventional magnetic core and the shield plate (the samples 3-7 and 3-8) which have the AC secondary outputs of 30.3 mV and 30.5 mV; the overinput characteristics of 10.1% and 10.3%; the percent residual outputs as the unbalanced characteristics of 4.0% and 8.2% and the residual outputs of 1.2 mV and 2.5 mV. The residual current transformers of the present invention have remarkably advantageous characteristics from the total viewpoints. The temperature characteristics of the outputs are substantially the same to be satisfactory.

The residual percent of residual output of the residual current transformer having the magnetic core having small number of the narrow sectional area parts is remarkably superior to that of the conventional one. However, that of the magnetic core having large number of the narrow sectional area parts is similar to that of the conventional one.

The secondary output, the overinput characteristic and the residual output of the residual current transformer are affected by the preparation thereof and accordingly, the complicated process for the preparation is required. However, in accordance with the present invention, these mutual effect is decreased to attain easy process for the preparation. The characteristics of the residual current transformer are remarkably improved and stabilized though such effects are not attained by the conventional one.

When the holes of the magnetic core plates to form the narrow sectional are a part are arranged to the same position, the characteristics are remarkably superior without a trouble. The mass production of the magnetic cores can be attained without any trouble caused by the formation of the holes.

We claim:

1. A residual current transformer, comprising:

an annular core of magnetic material, said core including a continuous magnetic path within said core, said core including at least one portion wherein the longitudinal cross-section of said core is reduced with respect to the longitudinal cross-section of the remainder of said core;

a first annular shield of magnetic material positioned concentric with respect to said core and located in parallel with a first side thereof;

a second annular shield of magnetic material positioned concentric with respect to said core and located in parallel with a second side thereof; and a secondary coil wound about the exterior of said annular core, said secondary coil being located between said annular core and said first and second annular shields.

2. A residual current transformer as recited in claim 1, wherein said annular core comprises:

a plurality of annular disks of magnetic material, said plurality of disks being concentrically stacked to form said core.

3. A residual current transformer as recited in claim 2, wherein:

each of said plurality of annular disks includes at least one opening passing therethrough, whereby the longitudinal cross-sectional area of each disk is reduced in the vicinity of said at least one opening.

4. A residual current transformer as recited in claim 3, wherein:

each of said plurality of disks are rotationally aligned with respect to each other such that each said at least one opening in each disk is aligned with a common axis.

5. A residual current transformer as recited in claim 3, wherein:

each of said plurality of disks are rotationally aligned with respect to each other such that said at least one opening in each disk is displaced by a given distance from said at least one opening in each of the remaining disks.

6. A residual current transformer as recited in claim 3, wherein:

said at least one opening has a cross-sectional shape selected from the group of shapes consisting of: circle, rectangle, square, triangle, rhombus, polygon, and ellipse.

7. A residual current transformer as recited in claim 1, wherein said annular core comprises:

a continuous tape of magnetic material, said tape being wound in a spiral such that an annular body is formed.

8. A residual current transformer as recited in claim 7, wherein:

said continuous tape includes a plurality of openings passing therethrough, said openings being spaced apart from each other and positioned along a longitudinal axis of said tape.

* * * * *